US008357480B2

(12) United States Patent
Kamoto

(10) Patent No.: US 8,357,480 B2
(45) Date of Patent: Jan. 22, 2013

(54) CARRIER, DEVELOPER, DEVELOPING APPARATUS AND IMAGE FORMING APPARATUS

(75) Inventor: Takanori Kamoto, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 736 days.

(21) Appl. No.: 12/399,301

(22) Filed: Mar. 6, 2009

(65) Prior Publication Data

US 2009/0226838 A1 Sep. 10, 2009

(30) Foreign Application Priority Data

Mar. 7, 2008 (JP) ..... P2008-058735

(51) Int. Cl.
*G03G 9/00* (2006.01)

(52) U.S. Cl. ..... 430/111.32; 430/111.34; 430/114

(58) Field of Classification Search ..... 430/11.35, 430/114, 111.35
See application file for complete search history.

(56) References Cited

U.S. PATENT DOCUMENTS

| | | | | |
|---|---|---|---|---|
| 5,652,079 | A | 7/1997 | Mochizuki et al. | |
| 5,698,357 | A | 12/1997 | Inoue et al. | |
| 6,130,019 | A | 10/2000 | Nishikawa et al. | |
| 6,210,850 | B1 | 4/2001 | Ogata et al. | |
| 2005/0233239 | A1 | 10/2005 | Fujiwara et al. | |
| 2006/0269863 | A1* | 11/2006 | Nakamura et al. | 430/111.35 |
| 2007/0141503 | A1* | 6/2007 | Matsuoka et al. | 430/114 |

FOREIGN PATENT DOCUMENTS

| | | |
|---|---|---|
| JP | 08-234501 | 9/1996 |
| JP | 09-120174 | 5/1997 |
| JP | 11-174739 | 7/1999 |
| JP | 2000-235283 | 8/2000 |
| JP | 2005-308923 | 11/2005 |
| JP | 2006-178508 | 7/2006 |

* cited by examiner

*Primary Examiner* — Mark F Huff
*Assistant Examiner* — Rashid Alam
(74) *Attorney, Agent, or Firm* — Nixon & Vanderhye P.C.

(57) ABSTRACT

There are provided a carrier which enables stable charging of toner and formation of a stable, high-definition and high-quality image which has very few image defects such as a fog, as well as a developer, a developing apparatus, and an image forming apparatus. A carrier is obtained by including a carrier core and a coating layer with which a surface of the carrier core is coated, the coating layer being obtained by curing a resin composition for coating that includes a crosslinked silicone-modified acrylic resin containing a macromonomer represented by the following general formula (1). A developer is obtained by such a carrier and a toner.

(1)

5 Claims, 1 Drawing Sheet

CARRIER, DEVELOPER, DEVELOPING APPARATUS AND IMAGE FORMING APPARATUS

CROSS-REFERENCE TO RELATED APPLICATION

This application claims priority to Japanese Patent Application No. 2008-058735, which was filed on Mar. 7, 2008, the contents of which are incorporated herein by reference in its entirety.

BACKGROUND OF THE INVENTION

1. Field of the Invention

The present invention relates to a carrier, a developer, a developing apparatus and an image forming apparatus.

2. Description of the Related Art

1Office automation equipments have been remarkably developed in these days and in line with such development, there has been a wide spread of copiers, printers, facsimile machines, and the like machines which form images through the electrophotographic system. In general, an image is formed by way of a charging step, an exposing step, a developing step, a transferring step, a cleaning step, and a fixing step in an image forming apparatus which employs the electrophotographic system. Specifically, at the charging step, a surface of a photoreceptor serving as an image bearing member is evenly charged in a dark place. At the exposing step, the charged photoreceptor receives signal light derived from a document image, resulting in removal of charges on the exposed part of the photoreceptor whose surface thus carries an electrostatic image (an electrostatic latent image). At the developing step, an electrostatic-image-developing toner (hereinafter simply referred to as "toner" unless otherwise mentioned) is supplied to the electrostatic image on the surface of the photoreceptor, thereby forming a toner image (a visualized image). At the transferring step, a recording medium such as paper or sheet is brought into contact with the toner image on the surface of the photoreceptor, and the corona discharge is then generated toward the recording medium from one side thereof which is reverse to the side in contact with the toner image, to thereby provide the recording medium with charges of which polarity is opposite to that of charges of the toner, thus transferring the toner image onto the recording medium. At the fixing step, the toner image on the recording medium is fixed by heat, pressure, or the like means. At the cleaning step, the toner is collected which has not been transferred onto the recording medium and thus remains on the surface of the photoreceptor. Through the above steps, a desired image is formed by the image forming apparatus employing the electrophotographic system.

A usable developer for developing a toner image in the image forming apparatus employing the electrophotographic system includes a one-component developer containing only a toner and a two-component developer containing toner and carrier. The two-component developer is characterized in forming a high-quality image more easily because functions of stirring, conveying, and charging toner particles can be given by the carrier. Accordingly, since toner in two-component developer does not need to have functions of carrier, the two-component developer has characteristics that the controllability is improved due to such separation of the functions, and a high-quality image is easily obtained, compared with one-component developer containing toner particles solely. Therefore, a lot of development and research have been conducted with respect to toner suitable for use in combination with carrier.

The carrier has two fundamental functions including a function of stably charging toner to a desired charge amount and a function of carrying toner to a photoreceptor. Further, the carrier is stirred in a developer tank and carried onto a magnet roller to form a magnetic ear, followed by passing through a regulation blade and returning to the inside of the developer tank again so as to be repeatedly used. While continuously used in this way, the carrier is required to stably exert the fundamental functions, particularly to stably charge toner. In order to maintain such a function of carrier, methods for coating the surface of the carrier with a resin have been proposed.

Examples thereof include one for coating the surface of carrier with a styrene-acrylic copolymer resin or a polyurethane resin, each of which has high surface tension, and one for coating with a silicone resin or a fluorine resin, each of which conversely has low surface tension. However, a resin having high surface tension has excellent adhesiveness to a carrier core, but has a problem that toner-spent is likely to occur. On the other hand, a fluorine resin having low surface tension is effective against the toner-spent, but due to poor adhesiveness to the carrier core, has a problem that the coating resin separates from the carrier core when the carrier is stirred in the developer tank, which inhibits stable charging.

In order to improve these problems, carrier coated with a resin obtained by hybridizing an acrylic resin and a silicone resin has been proposed.

For example, Japanese Unexamined Patent Publications JP-A 8-234501 (1996) and JP-A 2006-178508 disclose a carrier formed by coating a surface of a carrier core with a copolymer of a specific silicone macromonomer and an acrylic resin.

Further, For examples JP-A 2000-235283 discloses carrier having a coating layer consisting of an acryl-modified silicone resin.

Along with the advancement of full-color electrophotography in recent years, a lot of improvements have been made to toner. An improvement to a toner external additive is included partly. The toner external additive provides fluidity to toner and has a function as an auxiliary for controlling a charge amount.

In the full-color electrophotography, for the purpose of improving toner transfer efficiency, an external additive having a large particle size tends to be added. On the other hand, as a ratio of an external additive having a large particle size that is present on the toner surface is increased, chances of contact between the toner and the carrier are inhibited, which makes it difficult to charge the toner stably. Furthermore, color toner has higher insulating properties due to a material thereof than monochrome toner, which makes it difficult to stabilize the charging.

Against such problems of chargeability, since the carrier disclosed in JP-A 8-234501 and 2006-178508 uses a water-soluble resin, it is concerned that variations in the charge amount become large in accordance with environmental variations such as variations in temperature or humidity. Furthermore, since an acryl resin itself is uncrosslinked, rubbing resistance expected in actual use is low, therefore, stability of charging with respect to the number of print sheets cannot be expected that much.

Meanwhile, in the carrier disclosed in JP-A 2000-235283, an acryl-modified silicone resin and an aminosilane coupling agent are used for controlling a charge amount and compensating for a problematic low chargeability of a silicone with an acrylic resin.

However, it is difficult to control charging beyond charging capability of the acryl-modified silicone resin, and when trying to further increase the charge amount, it is necessary to add the aminosilane coupling agent for controlling. However, when the charge amount is increased by the aminosilane coupling agent, the charge amount is capable of being increased in an initial usage state, but is likely to be decreased as the number of print sheets is increased. That is, charging property of a coating resin itself greatly influences charging performance for the toner, and an increase in the charge amount of the coating resin itself is required.

SUMMARY OF THE INVENTION

The invention has been made in view of the above-mentioned problems and its object is to provide a carrier which enables stable charging of toner which includes a hinder resin and a colorant and formation of a stable, high-definition and high-quality image which has very few image defects such as a fog, as well as a developer, a developing apparatus, and an image forming apparatus.

The invention provides a carrier comprising:

a carrier core; and a coating layer with which a surface of the carrier core is coated, the coating layer being obtained by curing a resin composition for coating that includes a crosslinked silicone-modified acrylic resin containing a macromonomer represented by the following general formula (1):

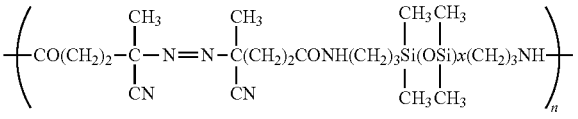

(1)

(wherein, x denotes an integer of 1 to 200 and n denotes an integer of 1 to 100.)

According to the invention, a surface of a carrier core is coated with a coating layer obtained by curing a resin composition for coating that includes a crosslinked silicone-modified acrylic resin containing a macromonomer represented by the general formula (1).

Such a silicone-modified acrylic resin has an effect of increasing a charge amount by containing a nitrile group, and is capable of decreasing the surface energy to reduce toner-spent by containing a siloxane bond. Further, the crosslink to an acryl allows the hardness of the resin to be controlled, thereby prolonging a life of the carrier.

Furthermore, in the invention, it is preferable that the carrier core is made of a ferrite core.

According to the invention, the carrier core is made of a ferrite core.

The ferrite core is excellent in charging performance and durability and has a suitable saturation magnetization, thus making it possible to perform coating with the crosslinked silicone-modified acrylic resin represented by the following general formula (1) easily.

Furthermore, in the invention, it is preferable that the carrier core has a volume average particle size in a range of from 25 to 100 μm.

According to the invention, the carrier core has a volume average particle size in a range of from 25 to 100 μm, resulting that it is possible to select a suitable carrier particle size also with respect to the toner having different particle sizes.

Furthermore, in the invention, it is preferable that the coating layer includes conductive particles.

According to the invention, the coating layer includes the conductive particles, resulting that it is possible to control a resistance value of the carrier and allow both improvement for developability and prevention of carrier adhesion.

Furthermore, in the invention, it is preferable that a ratio of the conductive particles to the silicone-modified acrylic resin included in the coating layer is 30 parts by weight or less based on 100 parts by weight of the latter.

According to the invention, a ratio of the conductive particles to the silicone-modified acrylic resin included in the coating layer is 30 parts by weight or less based on 100 parts by weight of the latter, resulting that it is possible to improve the mechanical intensity of the coating layer, adhesiveness to the carrier core and the like, and to form the coating layer sufficiently.

Furthermore, the invention provides a developer comprising the above-mentioned carrier and a toner including at least a binder resin and a colorant.

According to the invention, a developer comprises the above-mentioned carrier and a toner including at least a binder resin and a colorant, resulting that it is possible to obtain developer in which charging property is stable even when the number of print sheets is increased. By using such a developer, it is possible to reproduce a high-definition formed image and to form a high-quality image having excellent color reproducibility and high image density, which has very few image defects such as a fog stably.

Furthermore, in the invention, it is preferable that at least two of external additives having different particle sizes are externally added to the toner.

According to the invention, since at least two of external additives having different particle sizes are externally added to the toner, it is possible to improve fluidity to the toner effectively.

Furthermore, in the invention, it is preferable that at least one of the external additives has a primary particle size of 0.1 μm or more and 0.2 μm or less.

According to the invention, at least one of the external additives has a primary particle size of 0.1 μm or more and 0.2 μm or less, resulting that it is possible to prevent adhesion of the external additives to the surface of the carrier and improve transfer property without causing decrease in charging.

By combining the toner and the carrier in this way, the charge donating property from the carrier to the toner is further stabilized and the chargeability itself of the toner is therefore stabilized, thus making it possible to form a high definition, high-density and high-quality image while minimizing the toner consumption.

Furthermore, the invention provides a developing apparatus that performs development using the above-mentioned developer.

According to the invention, by performing development using the above-mentioned developer, it is possible to provide a developing apparatus capable of performing development while stabilizing a charge amount of the toner.

Furthermore, the invention provides an image forming apparatus comprising the above-mentioned developing apparatus.

According to the invention, by providing the developing apparatus, it is possible to provide an image forming apparatus capable of reproducing a high-definition image and forming a high-quality image having excellent color reproducibility and high image density, which has very few image defects such as a fog stably.

Furthermore, in the invention, it is preferable that the image forming apparatus further comprises a transfer section including an intermediate transfer body on which a plurality of toner images having different colors are to be formed.

According to the invention, by using a transfer section including an intermediate transfer body on which a plurality of toner images having different colors are to be formed, it is possible to realize stabilization of the toner chargeability for a long term and to exert the effect of forming a high-quality image stably more effectively.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
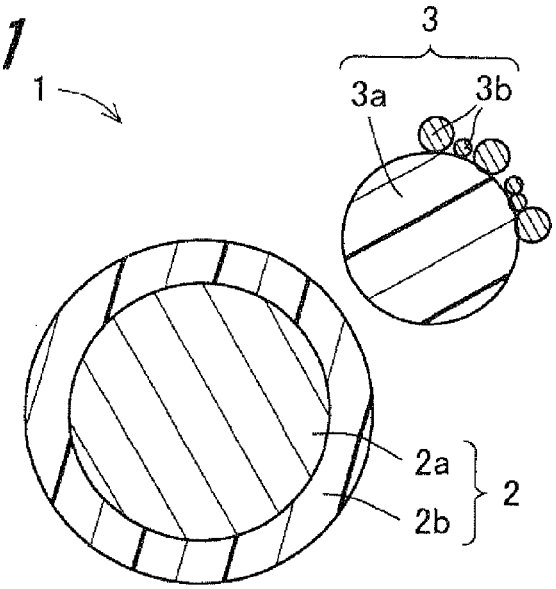
FIG. 1 is a schematic view showing a developer according to an embodiment of the invention.

Now referring to the drawings, preferred embodiments of the invention are described below.

Now referring to FIGS. 1 and 2, embodiments of the invention will be described.

FIG. 1 is a schematic view showing a developer 1 according to an embodiment of the invention. The developer 1 is a two-component developer including a carrier 2 and a toner 3. The toner 3, the carrier 2 and the developer 1 are described in this order. Hereinafter, unless followed by "particle", the entire toner or the entire carrier is indicated.

(Toner)

The toner 3 is configured so that, for example, two or more of external additives 3*b* having different particle sizes are added to a toner base particle 3*a*. The materials of the toner base particle 3*a* include a binder resin and a colorant as essential components, and a charge control agent, a release agent and the like in addition.

The binder resin is not particularly restricted, and a known binder resin for black toner or color toner is usable. Examples thereof include a polyester resin, a styrene resin such as polystyrene and a styrene-acrylic acid ester copolymer resin, an acrylic resin such as a polymethylmethacrylate, a polyolefin resin such as a polyethylene, a polyurethane, and an epoxy resin. In addition, a resin obtained by polymerization reaction by mixture of a monomer mixture material and a release agent may be used. The binder resins may be used each alone, or two or more of them may be used in combination.

In a case of using the polyester resin as the binder resin, examples of the aromatic alcohol ingredient required for obtaining the polyester resin include bisphenol A, polyoxyethylene-(2.2)-2,2-bis(4-hydroxyphenyl)propane, polyoxyethylene-(2.0)-2,2-bis(4-hydroxyphenyl)propane, polyoxypropylene-(2.0)-2,2-bis(4-hydroxyphenyl)propane, polyoxypropylene-(2.2)-polyoxyethylene-(2.0),-2,2-bis(4-hydroxyphenyl)propane, polyoxypropylene-(6)-2,2-bis(4-hydroxyphenyl)propane, polyoxypropylene-(2.2)-2,2-bis(4-hydroxyphenyl)propane, polyoxypropylene-(2.4)-2,2-bis(4-hydroxyphenyl)propane, polyoxypropylene-(3.3)-2,2-bis(4-hydroxyphenyl)propane, and derivatives thereof.

Further, examples of the polybasic acid ingredient in the polyester resin include dibasic acids such as succinic acid, adipic acid, sebasic acid, azelaic acid, dodecenyl succinic acid, n-dodecyl succinic acid, malonic acid, maleic acid, fumaric acid, citraconic acid, itaconic acid, glutaconic acid, cyclohexane dicarboxylic acid, ortho-phthalic acid, isophthalic acid, and terephthalic acid, tri- or higher basic acids such as trimellitic acid, trimethinic acid, and pyromellitic acid, as well as anhydrides and lower alkyl esters thereof. With a view point of heat resistant cohesion, terephthalic acid or lower alkyl esters thereof are preferred.

Here, the acid value of the polyester resin constituting the toner 3 is preferably from 5 to 30 mgKOH/g. In a case where the acid value is less than 5 mgKOH/g, the charging characteristic of the resin is lowered, and the organic bentonite as the charge controller is less dispersible in the polyester resin. They give undesired effects on the rising of the charged amount and the stability of the charged amount by repetitive development in continuous use. Accordingly, as the acid value, the above-mentioned range is preferable.

As a colorant, various kinds of colorants are usable in accordance with a desired color; for example, a yellow toner colorant, a magenta toner colorant, a cyan toner colorant, a black toner colorant and the like.

As a yellow toner colorant, examples thereof include, in reference to the color index classification, an organic pigment such as C. I. Pigment Yellow 1, C. I. Pigment Yellow 5, C. I. Pigment Yellow 12, C. I. Pigment Yellow 15 and C. I. Pigment Yellow 17, C. I. Pigment Yellow 74, C. I. Pigment Yellow 93, C. I. Pigment Yellow 180 or C. I. Pigment Yellow 185, an inorganic pigment such as a yellow iron oxide or an ocher, a nitro dye such as C. I. Acid Yellow 1, an oil soluble dye such as C. I. Solvent Yellow 2, C. T. Solvent Yellow 6, C. I. Solvent Yellow 14, C. I. Solvent Yellow 15, C. I. Solvent Yellow 19 or C. I. Solvent Yellow 21.

As a magenta toner colorant, examples thereof include, in reference to the color index classification, C. I. Pigment Red 49, C. I. Pigment Red 57, C. I. Pigment Red 81, C. I. Pigment Red 122, C. I. Solvent Red 19, C. I. Solvent Red 49, C. I. Solvent Red 52, C. I. Basic Red 10 and C. I. Disperse Red 15.

As a cyan toner colorant, examples thereof include, in reference to the color index classification, C. I. Pigment Blue 15, C. I. Pigment Blue 16, C. I. Solvent Blue 55, C. I. Solvent Blue 70, C. I. Direct Blue 25 and C. I. Direct Blue 86.

As a black toner colorant, examples thereof include carbon blacks such as channel black, roller black, disk black, gas furnace black, oil furnace black, thermal black, and acetylene black. The carbon black may be selected properly from among various kinds of carbon blacks mentioned above according to a target design characteristic of toner.

In addition to these pigments, a crimson pigment, a green pigment and the like are also usable as a colorant. The colorants may be used each alone, or two or more of them may be used in combination. Further, two or more of the similar color series are usable, or one of or two or more of the different color series are also usable.

The colorant may be used in the form of a masterbatch. The masterbatch of the colorant can be produced in the same manner as a general masterbatch. For example, a melted synthetic resin and a colorant are kneaded so that the colorant is uniformly dispersed in the synthetic resin, then the resultant mixture thus melt-kneaded is granulated to produce a masterbatch. For the synthetic resin, the same kind as the binder resin of the toner, or a synthetic resin having excellent compatibility with the binder resin of the toner is used. At this time, a ratio of the synthetic resin and the colorant to be used is not particularly restricted, but preferably 30 to 100 parts by weight based on 100 parts by weight of the synthetic resin. Further, the masterbatch is granulated so as to have a particle size of about 2 to 3 mm.

Further, the amount of a colorant to be used is not particularly restricted, but preferably 5 to 20 parts by weight based on 100 parts by weight of the binder resin. This amount does not refer to the amount of the masterbatch, but to the amount of the colorant itself included in the masterbatch. By using a colorant within such a range, it is possible to form a high-density and extremely high-quality image without damaging various physical properties of the toner.

The charge control agent is added for the purpose of controlling frictional electrification characteristic of the toner 3. The charge control agent is selected from a charge control agent for controlling positive charges and a charge control agent for controlling negative charges, which are commonly used in this field. Examples of the charge control agent for controlling positive charges include a basic dye, quaternary ammonium salt, quaternary phosphonium salt, aminopyrine, a pyrimidine compound, a polynuclear polyamino compound, aminosilane, a nigrosine dye, a derivative thereof, a triphenylmethane derivative, guanidine salt, and amidine salt. Examples of the charge control agent for controlling negative charges include oil-soluble dyes such as oil black and spiron black, a metal-containing azo compound, an azo complex dye, metal salt naphthenate, metal complex and metal salt of a salicylic acid and a derivative thereof, a boron compound, a fatty acid soap, long-chain alkylcarboxylic acid salt, and a resin acid soap. Chrome, zinc, and zirconium can be cited as the metal in the metal-containing azo compound, the azo complex dye, the metal salt naphthenate, the metal complex and metal salt of the salicylic acid and a derivative thereof. Among the above-stated charge control agent for controlling negative charges, the boron compound is particularly preferable because it contains no heavy metal. The charge control agent for controlling positive charges and the charge control agent for controlling negative charges can be used according to their intended applications. The charge control agents may be used each alone, or two or more of them may be used in combination as necessary. A usage of the charge control agent is not limited to a particular level and may be selected as appropriate from a wide range. A preferable usage of the charge control agent is 0.5 to 3 parts by weight based on 100 parts by weight of the binder resin.

The release agent can use the one commonly used in this field, and examples thereof include a petroleum wax such as a paraffin wax and a derivative thereof; a microcrystalline wax and a derivative thereof; a hydrocarbon synthetic wax such as a Fischer-Tropsch wax and a derivative thereof; a polyolefin wax and a derivative thereof; a low-molecular-weight polypropylene wax and a derivative thereof; a polyolefin polymer wax (a low-molecular-weight polyethylene wax and the like) and a derivative thereof; a botanical wax such as a carnauba wax and a derivative thereof; a rice wax and a derivative thereof; a candelilla wax and a derivative thereof; a plant wax such as a Japan wax; an animal wax such as a beeswax and a spermaceti wax; a synthetic wax of fat and oil such as a fatty acid amide and a phenol fatty acid ester; a long-chain carboxylic acid and a derivative thereof; a long-chain alcohol and a derivative thereof; a silicone polymer; and a higher fatty acid. Note that examples of the derivatives include an oxide, a vinyl monomer-wax block copolymer and a vinyl monomer-wax graft modified material. The amount of the release agent to be used is not particularly restricted and is appropriately selectable from a wide range, but preferably 0.2 to 20 parts by weight based on 100 parts by weight of the binder resin.

The external additive 3*b* of the toner 3 can use the one commonly used in the field, and examples thereof include a silicon oxide, a titanic oxide, a silicon carbide, an aluminum oxide and a barium titanate.

According to the embodiment, as the external additive 3*b*, two or more of external additives having different particle sizes are used in combination, and at least one of the external additives has a primary particle size of 0.1 μm or more and 0.2 μm or less. By using the external additive 3*b* in which at least one of the external additives has a primary particle size of 0.1 μm or more, it is possible to improve transfer property particularly with respect to color toner and to charge the toner 3 for long term and in a stable manner, without causing decrease in chargeability due to adhesion of the external additive to the surface of the carrier. The amount of the external additive 3*b* to be used is not particularly restricted, but preferably 0.1 to 3.0 parts by weight based on 100 parts by weight of the toner base particle 3*a*.

The materials for the toner 3, except for the external additive, are mixed by a mixer such as HENSCHEL MIXER, SUPERMIXER, MECHANOMILL or a Q-type mixer, and the material mixture thus acquired is melt-kneaded by a kneader such as a biaxial kneader, a uniaxial kneader or a continuous double-roller kneader, at a temperature of about 70 to 180° C., and thereafter cooled and solidified. After the material mixture of the toner 3 that has been melt-kneaded is cooled and solidified, the material mixture is coarsely pulverized by a cutter mill, a feather mill or the like. The material mixture thus pulverized coarsely is subjected to fine pulverization. For the fine pulverization, a jet mill, a fluidized-bed type jet mill or the like is used. Such mills perform pulverization of toner particles by causing air currents including the toner particles to collide with one another in a plurality of directions, thereby causing the toner particles to collide with one another. Whereby, it is possible to produce the nonmagnetic toner base particle 3*a* that has a specific particle size distribution. The particle size of the toner base particle 3*a* is not particularly restricted, but the average particle size thereof is preferably in a range of 3 to 10 μm. Furthermore, the particle size may be adjusted by classification and the like as necessary. To the toner base particle 3*a* thus produced, the above-mentioned external additive 3*b* is added by a known method. Note that, the method for producing the toner 3 is not restricted to the above.

(Carrier)

As shown in FIG. 1, in view of charging the toner 3 sufficiently and the like, the carrier 2 of the embodiment comprises a carrier core 2*a* and a coating layer 2*b* with which a surface of the carrier core 2*a* is coated, the coating layer 2*b* being obtained by curing a resin composition for coating that includes a crosslinked silicone-modified acrylic resin containing a macromonomer represented by the following general formula (1) and an acrylic monomer, and conductive particles.

(1)

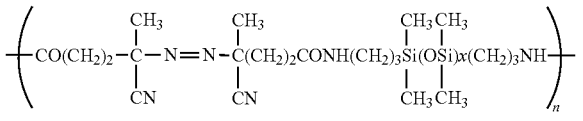

The macromonomer has a 2,2-azobisnitrile group and is a monomer including a siloxane bond, and in the formula, x denotes an integer of 1 to 200 and n denotes an integer of 1 to 100.

The silicone-modified acrylic resin has an effect of increasing a charge amount by including a nitrile group, and is capable of decreasing the surface energy to reduce the toner-spent by including a siloxane bond. Further, the crosslink to an acryl allows the hardness of the resin to be controlled, thereby prolonging a life of the carrier.

The carrier core 2*a* can use the one commonly used in this field, and examples thereof include a magnetic metal such as iron, copper, nickel and cobalt; and a magnetic metal oxide such as ferrite and magnetite. When the carrier core 2*a* is the above-mentioned magnetic material, it is possible to obtain a carrier suitable for a developer used in a magnetic brush development. The carrier core 2*a* preferably has a volume average particle size of 25 to 100 μm, in particular, 25 to 90 μm. When a volume average particle size of the carrier core 2*a* is less than 25 μm, the carrier 2 tends to separate from a developer carrying and bearing member, so that carrier adhesion, a phenomenon that the carrier 2 adheres to an image bearing member, is likely to occur. When the volume average particle size of the carrier core 2*a* exceeds 100 μm, the magnetic ear, which is an ear of a magnetic brush formed by causing the carrier to be magnetically attracted to a magnet roller described below, becomes too coarse, therefore, even when the particle size of the toner 3 is reduced, no improvement for image quality by the toner 3 is observed. In the embodiment, the volume average particle size is measured by a particle size analyzer (product name: Microtrac MT3000, manufactured by Nikkiso Co., Ltd.).

The resin composition for coating that forms the coating layer 2*b* on the surface of the carrier core 2*a* contains a crosslinked acrylic resin containing a macromonomer represented by the general formula (1) and conductive fine particles.

As the conductive particles, for example, oxide such as conductive carbon black, conductive titanium oxide, and tin oxide are used. Among the substances just cited, the conductive carbon black is preferred to develop, with a small amount thereof, sufficient conductivity. In the case of the use for a color toner, there is a concern about detachment of the carbon from the coating layer 2*b* of the carrier 2. In this case, it is preferable to use the antimony-doped conductive titanium oxide, and the like substance.

The resin composition for coating includes a silicone macromonomer represented by the general formula (1) and a plurality of polysiloxane chains, and is a crosslinkable silicone acrylic block copolymer.

Further, the resin composition for coating may contain bifunctional silicone oil, in order to further enhance the moisture resistance, releasing property, and the like property of the resin-coating layer formed of the silicone resin (especially, the cross-linked silicone resin).

The resin composition for coating is crosslinked with a hydroxyl group, an epoxy group, a carboxyl group, an active methylene group or an alkoxysiril group.

Examples of a method of applying the resin composition for coating to the surface of the carrier core 2*a* include a dipping method for impregnating the carrier core 2*a* with the resin composition for coating; a spraying method for spraying the carrier core 2*a* with the resin composition for coating; and a fluid bed process for spraying the carrier core 2*a* which is suspended in fluidizing air, with the resin composition for coating. Among the methods just cited, preferred is the dipping method in which a coating can be easily formed.

An application layer made of the resin composition for coating is cured at a heating temperature selected according to the type of the silicone resin, and a preferable heating temperature is around 150° C. to 280° C. As a matter of course, no heating is required in the case where the silicone resin in use is the cold setting silicone resin. In this case, however, there may be heating up to around 100° C. to 200° C. for the purpose of enhancing the mechanical strength of the to-be-formed resin-coating layer, shortening the length of time for curing, and the like effect.

Note that a concentration of total solid of the resin composition for coating is not particularly limited, and may be thus adjusted in consideration of workability for application onto the carrier core 2*a* so that a thickness of the cured coating layer 2*b* is generally 5 μm or less and preferably around 0.1 μm to 3 μm.

Although the carrier 2 thus obtained preferably has high electrical resistivity and a spherical shape, the effects of the invention are not lost even when the carrier has conductivity and a non-spherical shape.

(Developer)

The developer 1 can be manufactured by mixing the toner 3 with the external additive 3*b* added externally and the above-mentioned carrier 2. A mixing ratio of the toner 3 and the carrier 2 is not particularly limited and in consideration of the use thereof in a high-speed image forming apparatus (which forms A4-sized images on 40 sheets or more per minute), it is preferred that a ratio of a total projected area of the toner 3 (a sum of projected areas of all the toner particles) to a total surface area of the carrier (a sum of surface areas of all the carrier particles), that is, the total projected area of the toner/the total surface area of the carrier×100, is 30% to 70% in a state where a ratio represented by an average particle size of the carrier/an average particle size of the toner is 5 or more. This allows the charging property of the toner to be stably maintained in a sufficiently favorable state, resulting in a favorable developer which can stably form high-quality images for a long period of time even in a high-speed image forming apparatus. For example, assuming that: the volume average particle size of the toner is set at 6.5 μm; the volume average particle size of the carrier is set at 90 μm; and the ratio of the total projected area of the toner to the total surface area of the carrier is set in a range of 30% to 70%, the developer 1 will contain around 2.2 parts by weight to 5.3 parts by weight of the toner based on 100 parts by weight of the carrier. The high-speed development using the developer 1 as just described leads to the largest amount of toner consumption and the largest amount of toner supply that is supplied to a developer tank of a developing device according to the toner consumption. The balance of supply and demand will be nevertheless lost. And when the amount of the carrier 2 contained in the developer 1 exceeds a value around 2.2 parts by weight to 5.3 parts by weight, the amount of charges tends to be smaller, thus failing to obtain the desired developing property, and moreover the amount of toner consumption is larger than the amount of toner supply, thus failing to impart sufficient charges to the toner 3, which causes the deterioration of image quality. Furthermore, when the amount of the carrier 2 contained in the developer is small, the amount of charges tends to be larger and thus, the toner 3 is less easily separated from the carrier 2 through the electric field, thereby causing the deterioration of image quality.

Note that the total projected area of the toner was determined as follows. Assuming that specific gravity of the toner was 1.0, the total projected area of the toner was determined based on the volume average particle size obtained by a Coulter counter: COULTER COUNTER MULTISIZER II (trade name) manufactured by Beckman Coulter, Inc. That is, the number of the toners relative to the weight of the toners to be mixed was counted, and the number of the toners was multiplied by the area of the toners (which was obtained based on the assumption that the area is a circle) to thus obtain a total projected area of the toner. In a similar fashion, a total surface area of the carrier was determined from the weight of the carriers to be mixed based on the particle size which had been obtained by Microtrac: Microtrac MT3000 (trade name) manufactured by Nikkiso Co., Ltd. In this case, specific gravity of the carrier was defined as 4.7. Using the values obtained as above, the mixing ratio of the toner and the carrier was determined by the total projected area of the toner/the total surface area of the carrier×100.

(Developing Apparatus and Image Forming Apparatus)

A developing apparatus 20 according to an embodiment of the invention performs development by using the developer 1 of the embodiment. FIG. 2 is a schematic view showing the structure of the developing apparatus 20.

Figure 2:
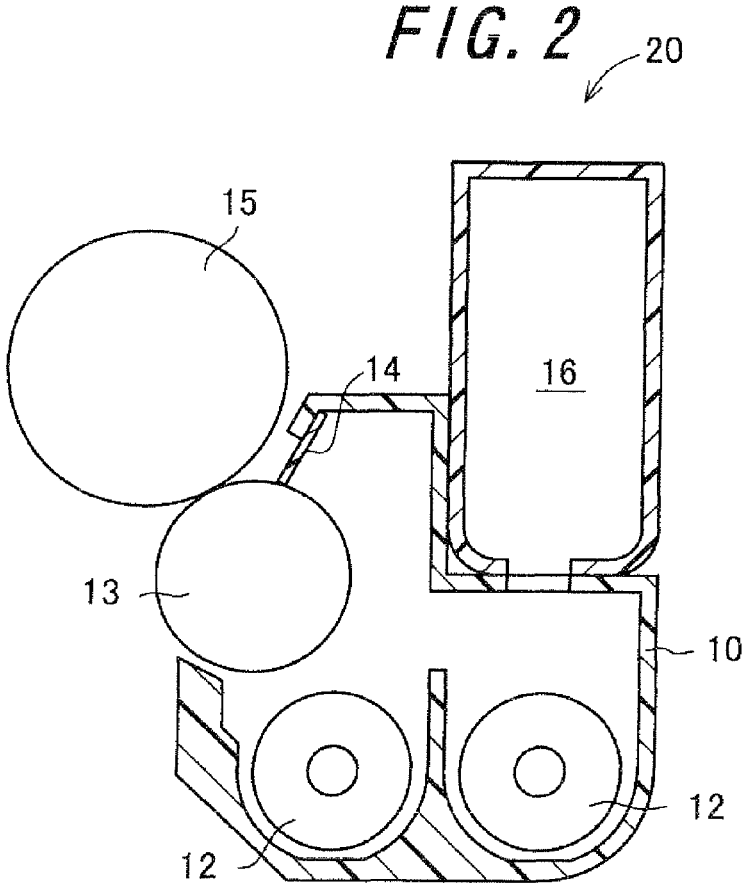
FIG. 2 is a schematic view showing the structure of a developing apparatus.

As shown in FIG. 2, the developing apparatus 20 includes a development unit 10 for storing the developer 1 and a developer bearing member (developer carrying and bearing member) 13 for carrying the developer 1 to an image bearing member (image forming body, photoreceptor) 15.

The developer (two-component developer) 1 of the embodiment, which comprises the toner 3 and the carrier 2 of the embodiment that has been supplied in advance to the inside of the development unit 10, is stirred and thereby charged by a stirring screw 12. Then, the developer 1 is carried by the developer bearing member 13 having therein-side a magnet roller serving as magnetic field generating section, thereby being held on the surface of the developer bearing member 13. The developer 1 held on the surface of the developer bearing member 13 is regulated by a developer regulating member 14 so as to have a constant thickness, then carried to a developing area formed in an area in which the developer bearing member 13 and the image bearing member 15 are close to each other, and thereafter an electrostatic image on the image bearing member 15 is made visible by reversal development in an oscillating electric field formed by applying an alternating bias voltage to the developer bearing member 13.

Further, the toner consumption resulting from formation of a visible image is detected by a toner density sensor (not shown) as variations in a toner density that is a weight ratio of the toner to the developer, and the amount consumed is replenished from a toner hopper 16 until the toner density sensor (not shown) detects that the toner density has reached a predetermined specified level, thereby the toner density of the developer 1 in the development unit 10 is maintained substantially at a constant level. Further, in the embodiment, a gap between the developer bearing member 13 and the developer regulating member 14, and a gap between the developer bearing member 13 and the image bearing member 15 in the developing area may be set, for example, to 0.4 mm. However, this is merely an example, and is therefore not restricted to this value.

Further, an image forming apparatus according to the embodiment of the invention includes the above-mentioned developing apparatus 20. As other structures of the developing apparatus 20, those of a known electrophotographic image forming apparatus are applicable, for example, including an image bearing member having a photosensitive layer on the surface of which an electrostatic image can be formed, a charging section for charging the surface of the image bearing member to a predetermined potential, an exposure section for forming an electrostatic image (electrostatic latent image) on the surface of the image bearing member by irradiating the image bearing member whose surface is in a charged state with signal light corresponding to image information, a transfer section for transferring a toner image on the surface of the image bearing member, which has been developed by the toner 3 supplied from the developing apparatus 20, onto an intermediate transfer body, then to a recording medium, a fixing section for fixing the toner image on the surface of a recoding medium on the recording medium, a cleaning section for removing toner, paper dust and the like that remain on the surface of the image bearing member after the toner image is transferred to the recording medium, and another cleaning section for removing redundant toner adhering to the intermediate transfer body. Further, a method for forming an image of the embodiment is performed by using the image forming apparatus of the embodiment that has the developing apparatus 20 of the embodiment.

When an electrostatic image is developed, a development step of allowing the electrostatic image on the image bearing member 15 to be visible by reversal development, is executed for each toner color, and a plurality of toner images having different colors are overlaid on the intermediate transfer body to form a multicolor toner image. Although an intermediate transfer method using an intermediate transfer body is adopted in the embodiment, the structure to transfer a toner image directly onto the recording medium from the image bearing member may be employed.

According to the developing apparatus of the embodiment, it is possible to realize stable formation of high-quality images with high resolution image reproduction, favorable color reproducibility, high image density, and a small number of image defects such as fog.

EXAMPLES

Specific descriptions will be given hereinbelow concerning Reference examples, Examples, Comparative examples, and Test examples. The invention is, however, not restricted to the present examples as long as included in a gist of the invention.

In the following examples and comparative examples, measurements were performed by using two-component developer including toner to which an external additive was added, and carrier. First, a method for preparing the carrier and the toner that are included in the developer used in the examples and comparative examples will be explained. Hereinafter, "part" refers to "parts by weight". Further, unless otherwise mentioned, "%" refers to "% by weight".

[Manufacture of Carriers]

Six kinds of carriers (Carriers (1) to (6)) were manufactured as follows. Using a three-one motor, silicone resin, conductive particles, a coupling agent, and a solvent were stirred for five minutes, each of which usage (part) was indicated in the following Table 1. There was thus prepared the silicone resin composition, i.e., the resin composition for coating. As the solvent, toluene was used. Note that the conductive fine particles had been dispersed in the toluene solvent in advance before use with the aid of a dispersant. The resin composition for coating was mixed with a ferrite core whose volume average particle size (μm) and usage (part) were indicated in the following Table 1, and then put in a stirring machine to be further mixed with each other. From an obtained admixture, toluene was removed under reduced pressure and heat so that an application layer was formed on a surface of the ferrite core. The application layer was heated at 200° C. for one hour to be cured, thereby forming a coating layer. the ferrite cores coated with the coating layer were then screened out through a 100 mesh. Carries (1) to (6) were thus manufactured.

The silicone resin and the conductive particles shown in Table 1 are specifically as follows.

Silicone-Modified Acrylic Resin: A

The silicone-modified acrylic resin was prepared by mixing RIPEL COAT 210A (product name, manufactured by Nippon Paint Co., Ltd.) that is a silicone-modified acrylic resin containing the structure of the general formula (1) and a curing agent RIPEL COAT B (product name, manufactured by Nippon Paint Co., Ltd.) in a ratio of 4 to 1.

Silicone-Modified Acrylic Resin: B

The silicone-modified acrylic resin was prepared by mixing KR9706 (product name, manufactured by Shin-Etsu Chemical Co., Ltd.) and D-15 (product name, manufactured by Shin-Etsu Chemical Co., Ltd.) in a ratio of 97 to 3.

Conductive Fine Particle: C

Product name: VULCANXC72, manufactured by Cabot Corporation (Carbon black-toluene dispersing conductive solution having a 15% solid concentration)

Conductive Fine Particle: D

Product name: FS-10P, manufactured by Ishihara Sangyo Kaisha, Ltd. (Titanic oxide-toluene dispersing conductive solution having a 30% solid concentration)

TABLE 1

| Carrier | Volume average particle size (μm) | Used amount (parts) | Modified acrylic resin Type | Modified acrylic resin Used amount (parts) | Conductive fine particles Type | Conductive fine particles Used amount (parts) | Toluene Used amount (parts) |
|---|---|---|---|---|---|---|---|
| 1 | 35 | 1000 | A | 45 | C | 6 | 20 |
| 2 | 45 | 1000 | A | 100 | C | 6 | 15 |
| 3 | 90 | 1000 | A | 50 | C | 3 | 20 |
| 4 | 55 | 1000 | A | 75 | D | 15 | 20 |
| 5 | 45 | 1000 | A | 15 | — | — | 150 |
| 6 | 45 | 1000 | B | 100 | C | 6 | 15 |
| 7 | 45 | 1000 | B | 100 | C | — | 150 |

(Preparation of Toner)

Four kinds of toners (Toners (1) to (4)) were prepared as follows.

| Toner (1) | |
|---|---|
| Polyester resin (acid value: 21 mgKOH/g; aromatic alcohol ingredient: PO-BPA and EP-BPA; acid ingredient: fumaric acid and mellitic acid anhydride) | 87.5 wt % |
| C.I. Pigment Blue 15:1 | 5 wt % |
| Non-polar paraffin wax (DSP peak: 78° C., Mw: $8.32 \times 10^2$, wherein Mw indicates a weight-average molecular weight) | 6 wt % |
| Charge controller (BONTRON E-84, manufactured by Orient Chemical Industries, Ltd.) | 1.5 wt % |

After pre-mixing each of the constituent materials described above by a Henschel mixer, they were melt-kneaded by a twin screw extrusion kneader. After coarsely pulverizing the kneaded product by a cutting mill, it was finely pulverized by a jet mill and then classified by a pneumatic classifier to prepare a toner base particle with an average particle size of 6.5 μm.

Then, 1.2% by weight of silica subjected to a hydrophobic treatment with i-butyltrimethoxy silane with a volume average particle size of 0.1 μm and 1.0% by weight of fine silica particles subjected to a hydrophobic treatment with HMDS with a volume average particle size of 12 nm were added to 97.8% by weight of the classified toner base particles, mixed in a Henschel mixer, and subjected to an external addition treatment to prepare Toner (1).

Toner (2)

Toner (2) was prepared in the same manner with use of the same materials as Toner (1), except that the colorant was changed from C. I. Pigment Blue 15:1 to a carbon black.

Toner (3)

Toner (3) was prepared in the same manner with use of the same materials as Toner (1), except that the charge control agent was changed from BONTRON E-81 to LR-147 (manufactured by Japan Carlit Co., Ltd.).

Toner (4)

Toner (4) was prepared in the same manner with use of the same materials as Toner (1), except that the hydrophobized silica by i-butyltrimethoxysilane having a volume average particle size of 0.1 μm was disused and 2.2% by weight of a silica fine particle having a volume average particle size of 12 nm, which was subjected to a hydrophobic treatment with HMDS, was used.

Note that, measurements of the volume average particle size of the carrier, the volume average particle size of the toner, the surface area of the carrier and the protected area of the toner that have been used in the examples and comparative examples were performed as follows.

[Volume Average Particle Size of Carrier]

About 10 to 15 mg of a sample for measurement was added to a 10 mL solution having 5% of EMULGEN 109P (manufactured by Kao Corporation, polyoxyethylene laurylether HLB 13.6), and then the mixture was dispersed by an ultrasonic dispersing device for one minute. About 1 mL of the mixture was added to a predetermined point of Microtrac MT3000 (manufactured by Nikkiso Co., Ltd.), and then stirred for one minute, and after it was confirmed that the scattered light intensity was stable, the measurement was performed.

[Volume Average Particle Size of Toner]

In a 100 mL beaker, 20 mL of an aqueous solution (electrolyte solution) having 1% (primary) sodium chloride was put, and to the solution, 0.5 mL of an alkyl benzene sulfonate (dispersing agent) and 3 mg of a toner sample were successively added, then the mixture was dispersed ultrasonically for 5 minutes. The aqueous solution having 1% (primary) sodium chloride was added to the mixture so that the total amount was 100 mL, the resultant mixture was ultrasonically dispersed for 5 minutes again to thereby obtain a measurement sample. With respect to the measurement sample, the volume average particle size was calculated by COULTER COUNTER TA-III (product name, manufactured by Beckman Coulter, Inc.) under the conditions that the aperture diameter was 100 μm and that the particle size to be measured was 2 to 40 μm for each particle.

[Total Surface Area of Carrier]

Specific gravity of the carrier was set to 4.7, and the total surface area of the carrier was determined from the weight of the carriers to be mixed based on the particle size which had been obtained by Microtrac MT3000 (trade name) manufactured by Nikkiso Co., Ltd.

[Total Projected Area of Toner]

Specific gravity of the toner was set to 1.0, and the number of the toners relative to the weight of the Loners to be mixed was counted based on the volume average particle size obtained by the Coulter counter: COULTER COUNTER MULTISIZER II (trade name) manufactured by Beckman Coulter, Inc., and the number of the toners was multiplied by the area of the toners (which was obtained based on the assumption that the area is a circle) to thus obtain a total projected area of the toner.

(Evaluation)

Next, description will be given for a method for evaluation and evaluation criteria in the evaluation conducted by using developer containing the carrier and the toner that have been prepared in the above.

[i. Initial Charge Amount]

Developers of various combinations of the above-mentioned toner and carrier were respectively set in a copier (converted from MX-6200N of Sharp Corporation) that has a two-component developing apparatus, and after the copier was run idle for 3 minutes at normal temperature and normal humidity, the developer was sampled, and subsequently the charge amount was measured by a suction type charge amount measuring apparatus (210H-2A Q/M Meter, manufactured by TREK Inc.) In the evaluation, a case where the charged amount was less than −20 μC/g was judged as "unusable"; a case where the charged amount was −20 μC/g or more was judged as "usable"; and a case where the charged amount was −25 μC/g or more and −45 μC/g or less was judged as "good".

[ii. Rising Characteristic of Charging]

After stirring a 5-ml glass bottle containing a developer including 0.95 g of the carrier and 0.05 g of the toner, which were manufactured above, for one minute by a rotary culturing machine at 32 rpm, the developer was sampled and the charged amount was measured by the suction type charged amount measuring apparatus. Further, after stirring for 3 minutes, the charged amount was measured in the same manner. In the evaluation, a case where the absolute value for the difference of charged amounts after one minute and after 3 minutes was larger than 7 μC/g was judged as "unusable"; a case where the absolute value for the difference of charged amounts after one minute and after 3 minutes was 7 μC/g or less was judged as "usable"; and a case where the value was 5 μC/g or less was judged as "good".

[iii. Decaying Characteristic of Charging]

After stirring a 100-ml polyethylene vessel containing a developer including 76 g of the carrier and 4 g of the toner, which were manufactured above, by a ball mill at 150 rpm for 60 minutes, the charged amount of the developer was measured and it was exposed to high temperature and high humidity. The charged amounts of the developer after one day, after 3 day, and after 10 day were measured. In the evaluation, a case where an absolute value for the difference relative to the charged amount at the first day was larger than 7 μC/g was judged as "unusable"; a case where the absolute value was 7 μC/g or less was judged as "usable"; and a case where the absolute value was 5 μC/g or less was judged as good.

[iv. Life Characteristic of Charging]

After installing the developer including the toner and the carrier, which were manufactured above, in a commercial copying machine having a two component developing device (MX-6000N, manufactured by Sharp Corp.), actually 50,000 sheets of solid images were copied at normal temperature and normal humidity.

The charged amount of the developer was measured by a suction type charged amount measuring apparatus. In the evaluation, a case where the absolute value for the difference relative to the initial charged amount was larger than 7 μC/g was judged as "unusable"; a case where the absolute value was 7 μC/g or less was judged as "usable"; and a case where the absolute value was 5 μC/g or less was judged as "good".

[v. Comprehensive Evaluation]

A comprehensive evaluation was performed by rating, including "Excellent" showing that all of the measurements i to iv were evaluated as "good"; "Good" showing that there were one or more evaluation of "usable" but no evaluation of "unusable"; and "Poor" showing that there were one or more evaluation of "unusable".

The following Table 2 shows results of the measurements i to v.

TABLE 2

| | | | Charge amount (-μc/g) | | | | | | | | |
|---|---|---|---|---|---|---|---|---|---|---|---|
| | | | | Property at the rise | | Attenuation property | | | | | |
| | Toner | Carrier | Initial | 1 min later | 3 min later | 1st day | 1 day later | 3 days later | 10 days later | Life property 50000 sheets | Comprehensive evaluation |
| Example 1 | 1 | 1 | 33 | 30 | 32 | 33 | 32 | 32 | 32 | 33 | Excellent |
| Example 2 | 1 | 2 | 35 | 30 | 34 | 35 | 35 | 33 | 33 | 34 | Excellent |
| Example 3 | 1 | 3 | 36 | 32 | 35 | 36 | 36 | 34 | 34 | 33 | Excellent |
| Example 4 | 1 | 4 | 31 | 31 | 31 | 31 | 30 | 30 | 30 | 30 | Good |
| Example 5 | 2 | 1 | 35 | 32 | 35 | 35 | 35 | 33 | 33 | 34 | Good |
| Example 6 | 2 | 2 | 34 | 32 | 35 | 34 | 34 | 32 | 31 | 33 | Excellent |
| Example 7 | 2 | 3 | 35 | 31 | 34 | 35 | 34 | 34 | 34 | 33 | Good |
| Example 8 | 2 | 4 | 33 | 30 | 33 | 33 | 32 | 31 | 31 | 32 | Good |
| Example 9 | 3 | 1 | 34 | 32 | 33 | 34 | 34 | 34 | 34 | 33 | Excellent |
| Example 10 | 3 | 2 | 37 | 37 | 37 | 37 | 35 | 34 | 34 | 34 | Excellent |
| Example 11 | 3 | 3 | 36 | 36 | 36 | 36 | 35 | 35 | 35 | 35 | Good |
| Example 12 | 3 | 4 | 38 | 38 | 38 | 38 | 36 | 36 | 35 | 37 | Excellent |
| Comparative example 1 | 1 | 5 | 33 | 25 | 32 | 33 | 33 | 32 | 32 | 25 | Poor |
| Comparative example 2 | 1 | 6 | 34 | 31 | 34 | 34 | 34 | 30 | 38 | 21 | Poor |
| Comparative example 3 | 2 | 5 | 36 | 24 | 33 | 36 | 36 | 33 | 27 | 24 | Poor |
| Comparative example 4 | 2 | 6 | 35 | 33 | 34 | 35 | 32 | 29 | 28 | 25 | Poor |

TABLE 2-continued

| | | | Charge amount (-μc/g) | | | | | | | | |
|---|---|---|---|---|---|---|---|---|---|---|---|
| | | | | | | Attenuation property | | | | | |
| | | | Property at the rise | | | | | | 10 days | Life property | Comprehensive |
| | Toner | Carrier | Initial | 1 min later | 3 min later | 1st day | 1 day later | 3 days later | later | 50000 sheets | evaluation |
| Comparative example 5 | 4 | 1 | 36 | 33 | 33 | 36 | 36 | 35 | 34 | 33 | Poor |

According to the Table 2, Examples 1 to 12 show that a macromonomer of the general formula (1) is included in the coating layer of the carrier in any of the color toner (Toner (1), Toner (3) and the black toner (Toner (2)), and it is possible to stabilize the charging property at the rise of charging, the attenuation property and the life property.

Comparative examples 1 to 4 show that the life property significantly decreases greatly when the coating layer of the carrier includes no macromonomer of the general formula (1) (Comparative examples 1 to 4 using Carriers (5) and (6)).

The invention is not restricted to the above-mentioned embodiments and examples and many modifications are possible within the scope of the claims. Accordingly, the embodiments and the examples obtained by combining technical sections modified as appropriate within the scope of the claims are also included in the technical range of the invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developer comprising a carrier comprising:

a carrier core; and a coating layer with which a surface of the carrier core is coated, the coating layer being obtained by curing a resin composition for coating that includes conductive particles and a crosslinked silicone-modified acrylic resin containing a macromonomer represented by the following general formula (1):

(1)

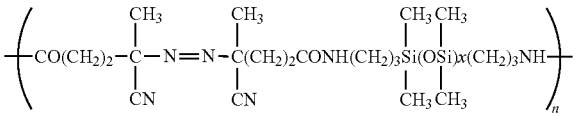

(wherein, x denotes an integer of 1 to 200 and n denotes an integer of 1 to 100), and an acrylic monomer; and a toner including at least a binder resin and a colorant, at least two external additives having different particle sizes being externally added to the toner.

2. The developer of claim 1, wherein the carrier core is made of a ferrite core.

3. The developer of claim 1, wherein the carrier core has a volume average particle size in a range of from 25 to 100 μm.

4. The developer of claim 1, wherein a ratio of the conductive particles to the silicone-modified acrylic resin included in the coating layer is 30 parts by weight or less based on 100 parts by weight of the latter.

5. The developer of claim 1, wherein at least one of the external additives has a primary particle size of 0.1 μm or more and 0.2 μm or less.

* * * * *